US005989165A

United States Patent [19]

Giannelli et al.

[11] Patent Number: 5,989,165

[45] **Date of Patent: *Nov. 23, 1999**

[54] INCLINE PRESS APPARATUS FOR EXERCISING REGIONS OF THE UPPER BODY

[75] Inventors: Raymond Giannelli, Franklin, Mass.; Jerry K. Leipheimer, Jamestown, Pa.

[73] Assignee: Cybex International, Inc., Medway, Mass.

[ * ] Notice: This patent is subject to a terminal disclaimer.

[21] Appl. No.: 08/941,593

[22] Filed: Sep. 30, 1997

Related U.S. Application Data

[60] Provisional application No. 60/027,204, Sep. 30, 1996.

[51] Int. Cl.[6] ..... A63B 21/06; A63B 23/035

[52] U.S. Cl. ..... 482/100; 482/136

[58] Field of Search ..... 482/72, 73, 94, 482/97–101, 112, 113, 129, 130, 135, 139, 133

[56] References Cited

U.S. PATENT DOCUMENTS

| | | | |
|---|---|---|---|
| 4,411,424 | 10/1983 | Barnett | 482/100 |
| 5,336,148 | 8/1994 | Ish, III | 482/97 X |
| 5,437,589 | 8/1995 | Habing | 482/100 R |
| 5,554,089 | 9/1996 | Jones | 482/97 |
| 5,582,564 | 12/1996 | Nichols, Sr. et al. | 482/97 |
| 5,707,323 | 1/1998 | Simonson | 482/97 |

*Primary Examiner*—John Mulcahy

*Attorney, Agent, or Firm*—Wolf, Greenfield & Sacks, P.C.

[57] ABSTRACT

An incline press exercise apparatus is provided. The incline press apparatus includes a selectable weight mechanism and a support member which pivotably supports a pair of four-bar linkage mechanisms. The four-bar linkage mechanisms are pivotably mounted at their rearward ends about axes which are disposed at an angle relative to a horizontal plane, i.e. are tilted relative to vertical, such that a pair of elongated bars of the four-bar linkage mechanisms travel in planes which are tilted relative to vertical. The tilted planes through which the four-bar linkage mechanisms travel enable the handles to travel along a slightly curvilinear downwardly diverging path which simulates as natural a human musculoskeletal pushing motion as possible.

27 Claims, 9 Drawing Sheets

INCLINE PRESS APPARATUS FOR EXERCISING REGIONS OF THE UPPER BODY

RELATED APPLICATIONS

This application claims priority under 35 USC § 119 (e) to commonly-owned, co-pending U.S. provisional patent application Ser. No. 60/027,204 entitled "Incline Press Apparatus for Excercising Regions of the Upper Body", filed Sep. 30, 1996 by Giannelli et al., which is incorporated herein by reference in its entirety.

BACKGROUND

1. Field of the Invention

The present invention relates to an apparati for exercising regions of the upper body, and more particularly to an improved incline press exercise machine.

2. Background of the Invention

A variety of exercise machines which utilize resistance or strength training have become very popular in recent years. Such strength machines are often used in place of conventional free weights to exercise a variety of muscles within the human body. Most strength machines are designed with the goal of optimizing resistance training benefits to the user by combining adjustable weight resistance with ease of use, while also attempting to maintain proper biomechanical alignment of the user's joints.

While such machines offer convenience and other benefits to the user in comparison to free weights, conventional designs typically include a frame superstructure for providing symmetrical balance and support for various levers and weight components of the machines. Such conventional frame superstructures generally result in machines that are oversized in height, width, and architecture. In addition, many of such conventional machines may be inconvenient to users performing more than one repetition of an exercise with varying weights, as the user is generally required to be physically removed from the machine in order to place weights on, or otherwise select the desired weight force before performing each set.

Another limitation found in conventional strength machines utilizing selectable weights is the inability of the user to perform high velocity exercises. In such conventional machines the weights have inertial problems at higher speeds which can result in inconsistent resistance through a complete range of motion, therefore, users are encouraged to perform the exercises slowly. Training at lower velocities produces greater increases in muscular force at slow speeds for the user. Therefore, low velocity training only improves an individual's capabilities at slower speeds. In contrast, training at higher contractal velocities produces increases in an individual's muscular force at all speeds of contraction at and below the training velocity. Therefore, high velocity training improves an individual's functional capabilities at normal contractal velocities, i.e. velocities utilized for activities such as golfing and tennis which are more likely to be a part of every day living. Although there are many forms of strength training which allow for higher velocity training, the resistance mechanisms of such equipment generally do not include selectable weights, these devices do not utilize selectable weights as part of their resistance mechanism, and many users prefer training with selectable weights as opposed to other forms of resistance training, for example, resistance bands.

Conventional resistance equipment may also be limited by designs that prevent users from maintaining the proper biomechanical alignment of joints through a complete range of motion. A variety of machines have been proposed to improve the range of motion of the user, in order to make the exercise performed through the range more effective. Such machines are disclosed in, but not limited to, U.S. Pat. Nos. 5,437,589 and 5,273,504. However, the equipment disclosed in such references does not consistently provide proper biomechanical alignment of the user's joints through the complete range of motion.

Therefore, a need exists in the field of resistance training for selectable weight equipment that allows users to maintain the proper biomechanical alignment of joints through a complete range of motion, while performing exercises at high contractal velocities.

SUMMARY

In accordance with the invention there is provided an incline press exercise apparatus comprising a selectable weight mechanism and a support member which pivotally supports a pair of four-bar linkage mechanisms. The selectable weight mechanism is disposed in an off-center position relative to the exercise ready seating position of the user, such that the user can readily access and manually adjust/select the degree of weight force from a seated, exercise ready position. The selectable weight mechanism is preferably mounted in a relatively short weight support frame, typically less than about 3.5 feet in height. The four-bar linkage mechanisms are pivotally mounted at their rearward ends about axes which are disposed at an angle relative to a horizontal plane, i.e. are tilted relative to vertical, such that a pair of elongated bars of the four-bar linkage mechanisms travel in planes which are tilted relative to vertical. A pair of handles are rigidly connected to the forward most bar component of the four-bar linkage mechanisms such that the handles follow the same pivoting movement as the forward most bar component when the four-bar linkage mechanisms are pivoted around the rearward mounted, tilted axes. When utilizing a neutral grip the four-bar linkage mechanisms enable the user to maintain the proper biomechanical alignment of the joints. If a horizontal grip is utilized then the tilted axes maintain the proper alignment of the wrists. The tilted planes through which the four-bar linkage mechanisms travel enable the handles to travel along a slightly converging curvilinear path which simulates as natural a human musculoskeletal pushing motion as possible. The four-bar linkage mechanisms are preferably mounted to an upright support. A cable and pulley are interconnected between the four-bar linkage mechanisms and the shortened selectable weight mechanism such that as the four-bar linkage mechanisms are pivoted around their corresponding primary axis the selected weight is pulled through a relatively short vertical path, preferably about 1 foot. The distance between the point where the cables are connected to the four-bar linkage mechanisms and the forward most bar of the four-bar linkage mechanisms to which the handles are connected is such that the user has increased leverage control over the pulling of the selected weight resistance.

SUMMARY

In accordance with the invention there is provided a incline press exercise apparatus comprising a selectable weight mechanism and a support mechanism which pivotally supports a pair of four-bar linkage mechanisms. The selectable weight mechanism is disposed in an off-center position relative to the exercise ready seating position of the user, such that the user can readily access and manually adjust/select the degree of weight force from a seated, exercise ready position. The selectable weight mechanism is preferably mounted in a relatively short weight support frame, typically less than about 3.5 feet in height. The four bar linkage mechanisms are pivotally mounted at their rearward ends about axes which are disposed at an angle relative to a horizontal plane, i.e. are tilted relative to vertical, such that a pair of elongated bars of the four bar linkage mechanisms travel in planes which are tilted relative to vertical. A pair of handles are rigidly connected to the forward most bar component of the four-bar linkage mechanisms such that the handles follow the same pivoting movement as the forward most bar component, as the four bar linkage mechanism are pivoted around the rearward mounted, tilted axes. When utilizing a neutral grip the four-bar linkage mechanisms enable the user to maintain the proper biomechanical alignment of the joints. If a horizontal grip is utilized then the tilted axes maintain the proper alignment of the wrists. The tilted planes through which the four bar linkage mechanisms travel enable the handles to travel along a slightly curvilinear outwardly converging path which simulates as natural a human musculoskeletal outward pushing motion as possible. The four bar linkage mechanisms are preferably mounted to an upright support. A cable and pulley are interconnected between the four-bar linkage mechanisms and the shortened selectable weight mechanism such that as the four bar linkage mechanisms are pivoted around their corresponding primary axis the selected weight is pulled through a relatively short vertical path, preferably about 1 foot. The distance between the point were the cables are connected to the four bar linkage mechanisms and the forward most bar of the four bar linkage mechanisms to which the handles are connected is such that the user has increased leverage control over the pulling of the selected weight resistance.

Accordingly, the present invention is directed to a incline press exercise apparatus that includes a base member and a support member extending from the base member. A pair of four-bar linkage mechanisms are supported by the support member. Each of the pair of four-bar linkage mechanisms includes a primary lever arm pivotable about a primary axis and a follower lever arm pivotable about a secondary axis. The primary axes are disposed at an angle with respect to each other. The primary and follower lever arms lie in a common plane tilted at an angle relative to a vertical plane, which vertical plane is perpendicular to a horizontal plane underlying the base member. The apparatus also includes a weight mechanism operatively associated with the pair of four-bar linkage mechanisms. The primary and follower lever arms travel in the common plane as the pair of four-bar linkage mechanisms are displaced between a first position and a second position while maintaining a correct biomechanical positioning of the user.

In another aspect of the invention, the incline press exercise apparatus includes a handle lever arm operatively associated with both of the primary and follower arms of each of the pair of four-bar linkage mechanisms. A handle extends from each handle lever arms, each handle extending outwardly and perpendicularly from the handle lever arm, and curving outwardly and downwardly therefrom at a 90 degree angle. The handles travel in a slightly curvilinear upwardly converging and downwardly diverging path as the four-bar linkage mechanisms are displaced between a first position and a second position, while maintaining the correct biomechanical positioning of the user.

In another aspect of the present invention, the support member includes at least one post member connected to the base member extending upwardly behind a seat. The first and second four-bar linkage mechanisms are supported on the at least one post member above and behind the seat. The primary and follower lever arms travel in the common plane as the four-bar linkage mechanisms are displaced between a first position and a second position.

In another aspect of the invention, the first and second four-bar linkage mechanisms each have a length, and are each pivotally supported at a first selected position along the length, each having a handle connected to a second selected position along the length. The apparatus includes a seat which positions a user in a disposition relative to the handles such that the handles are manually engageable by the user for pushing the handles between the first position and the second position in a incline press motion.

In another aspect of the invention, the incline press exercise apparatus includes a handle lever arm operatively associated with each of the primary and follower lever arms. The handle lever arm includes a manually engageable handle for moving the four-bar linkage mechanisms between the first and second positions. The handle is disposed in a predetermined gripping orientation in the starting position such that the operative association of the handle lever arm with the primary and follower arms maintains the handle extension in the predetermined gripping orientation during displacement of the four-bar linkage arms between the first and second positions.

In another aspect of the invention, at least one of the primary and follower lever arms of each of the four-bar linkage mechanisms is operatively associated with a cable and a selected portion of a selectable weight stack. The selected portion of the weight stack is displaced by a distance upon movement of the fourbar linkage arms from a first position to a second position.

In another aspect of the invention, the primary and follower lever arms each have a length, and a handle interconnected to a first position along the length of at least one of the four-bar linkage mechanisms. The cable is interconnected to a second position along the length of at least one of the four-bar linkage mechansims. The first and second interconnection positions of the handle and the cable are selected such that the handle travels through a distance less than about 60% of the displacement distance of the selected portion of the weight stack upon displacement of the four-bar linkage mechanisms from a first position to a second position.

BRIEF DESCRIPTION OF THE DRAWINGS

It is to be understood that the following drawings are for the purpose of illustration only and are not intended as a definition of the limits of the invention. Objects and advantages of the present invention will become apparent with reference to the following detailed description when taken in conjunction with the following drawings, which disclose an embodiment of the invention, wherein the same reference numerals identify the same feature, in which.

DETAILED DESCRIPTION OF THE PREFERRED EMBODIMENTS

Figure 1:
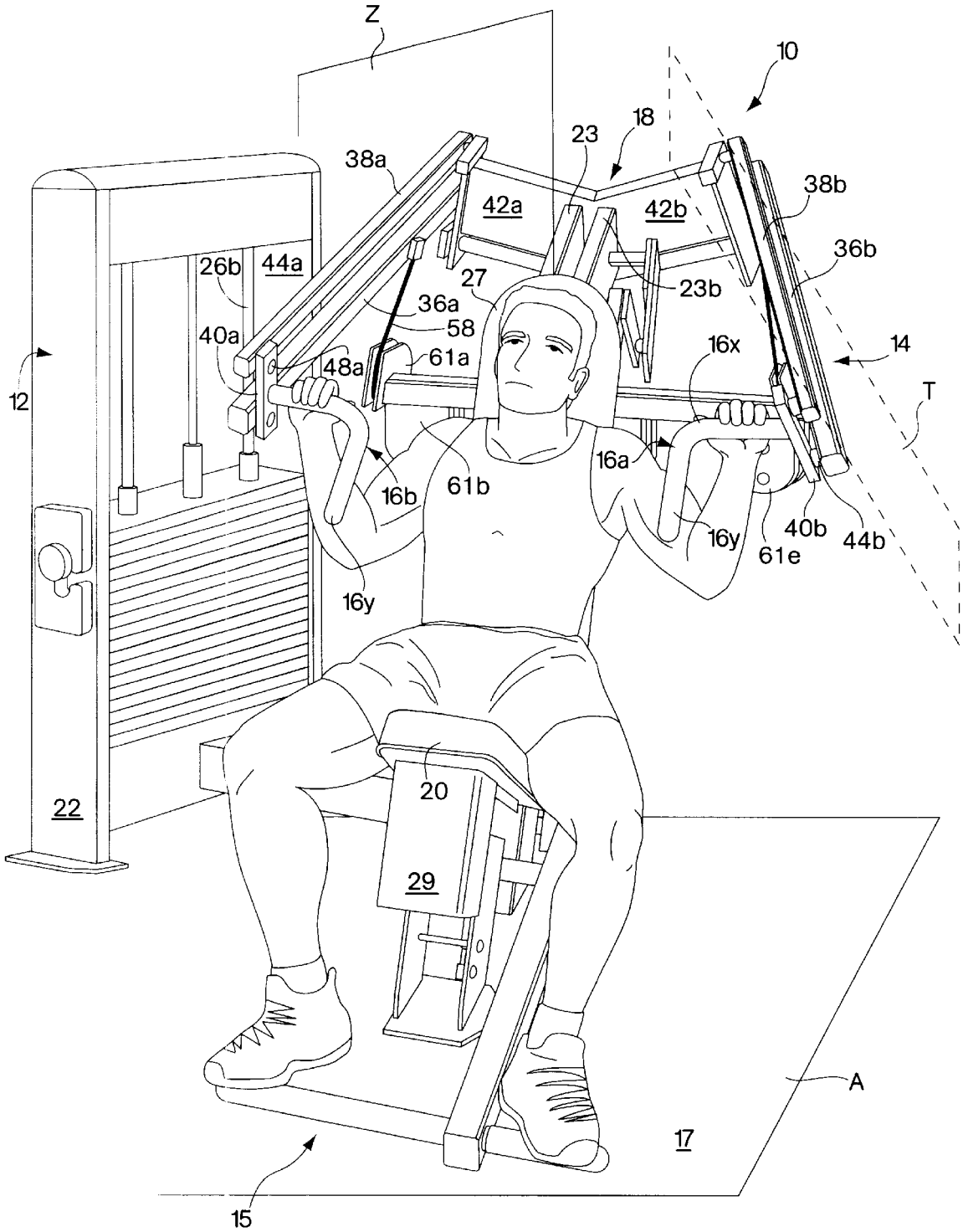
FIG. 1 is a perspective view of an incline press apparatus according to the present invention with a user in a starting position using a horizontal grip.

Referring initially to FIG. 1, there is illustrated a perspective view of an incline press exercise machine 10, according to one embodiment of the present invention. The incline press exercise machine 10 preferably includes a support member 18 for supporting a pair of four-bar linkage mechanisms 14*a* and *b*, as well as for supporting a seat 20, a selectable weight mechanism 12 operatively connected to each of the pair of four-bar linkages 14*a* and 14*b*, and a pair of handles 16*a* and 16*b* extending from each of the four-bar linkages 14*a* and *b*, respectively.

Figure 3:
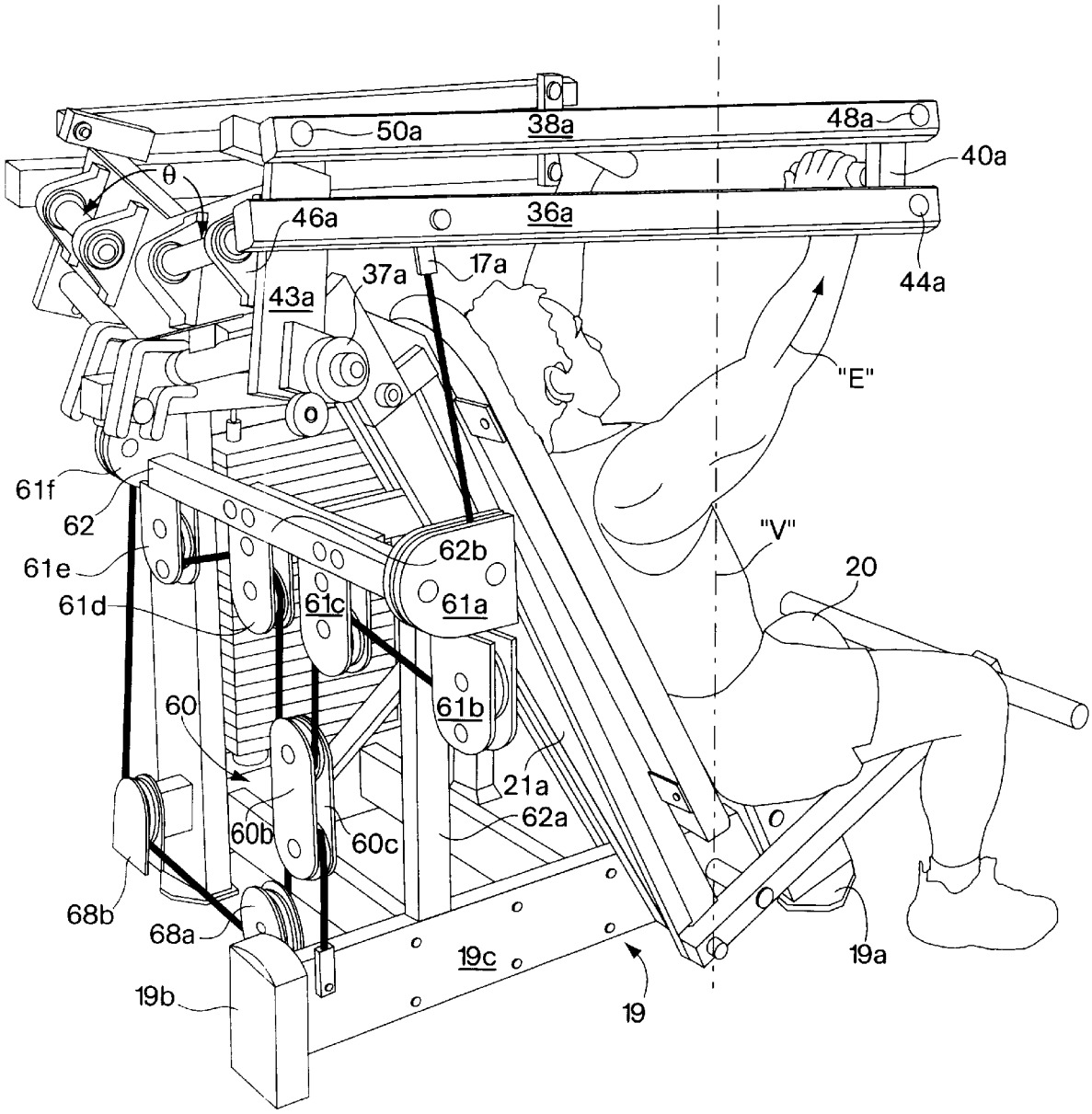
FIG. 3 is rear perspective view of the incline press apparatus of FIG. 1 showing showing a user inactive position.

Referring now to FIG. 3, the support member 18 is preferably constructed of a rigid material such as steel, and includes a base member 19, a pair of post members 21*a* and 21*b*, a cross bar assembly 62 and a pair of extensions 23*a* and 23*b*, all of which combine to form the structural elements of the support member 18. The base member 19 preferably includes a first support member 19*a*, a second support member 19*b* and a mounting member 19*c* disposed therebetween. First and second support members 19*a* and 19*b* preferably rest on a substantially horizontal, flat surface, such as a floor 17. Preferably a foot start 15 is located adjacent the first support member 19*a* so that a user can easily grasp the handles 16*a* and *b* in order to begin exercising, as described in greater detail herein below. In the present embodiment mounting member 19*c* is preferably supported at one end by the first support member 19*a*, at an opposite end by the second support member 19*b*, and is preferably spaced from and substantially parallel to the floor 17.

With continued reference to FIG. 3, the post members 21*a* and 21*b* preferably extend at an angle of approximately 30° from a vertical axis (FIG. 3), in the present embodiment, and operate to support a seat 20 in a reclined position. A cross bar assembly 62 preferably includes a mounting post 62*a* and a cross bar member 62*b* mounted transversely to mounting post 62*a* Extensions 23*a* and 23*b* are preferably mounted to and extend from the post members 21*a* and 21*b*, respectively. In the present embodiment, the extensions 23*a* and 23*b* extend from the post members 21*a* and 21*b* at a rearwardly facing angle. It will be understood to one of skill in the art that any number of structural elements, having a variety of shapes, sizes and orientations, may be utilized to form the support 18, as long as the structural orientation supports the four-bar linkages as the user exercises against a selected resistance.

Referring again to FIG. 1, the seat 20 preferably includes a seat cushion 25 and a support cushion 27, is supported in a reclined position, and is preferably adjustable between a plurality of vertical positions. The seat cushion 25 is supported by an angled seat mount 29 while the support cushion 27 is supported by the angled post members 21*a* and 21*b*. The seat 20 is mounted at an angle of approximately 30° with respect to a plane perpendicular to the floor 17 so as to properly orientate the user for performance of an incline press exercise. In the present embodiment, adjustment of the seat 20 is preferably enabled through a four-bar, gas-assist seat adjustment, although other methods of adjustment, for example hydraulic, may be utilized. A pin 33 (not shown) is insertable through each of a plurality of holes, in order to select the desired height of the seat. As with the support member 18, the seat 20 may be designed in a variety of configurations and dimensions, and may, or may not be adjustable.

Figure 8:
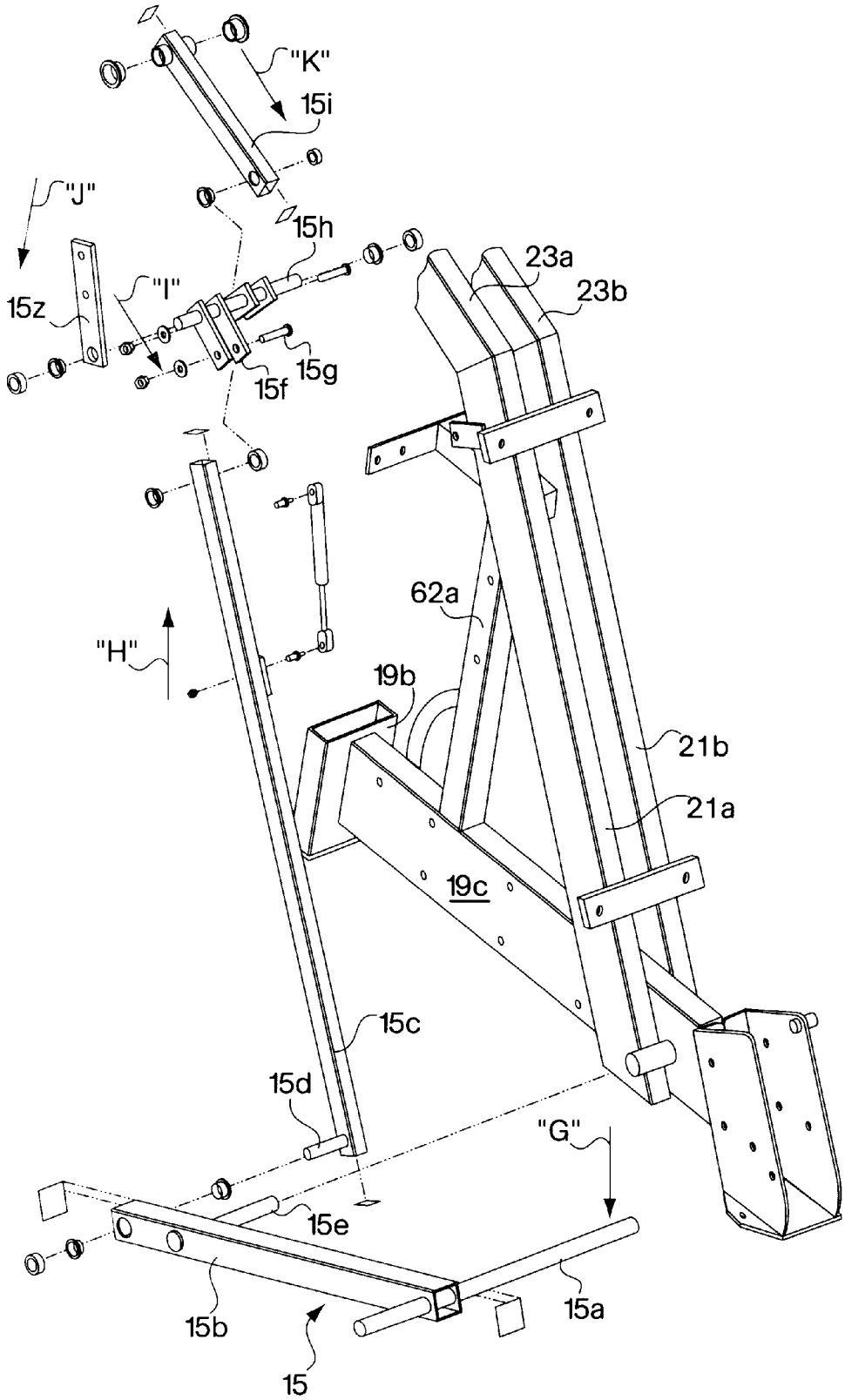
FIG. 8 is an exploded view of a portion of the four-bar linkage mechanisms of the incline press apparatus of FIG. 1.
Figure 9:
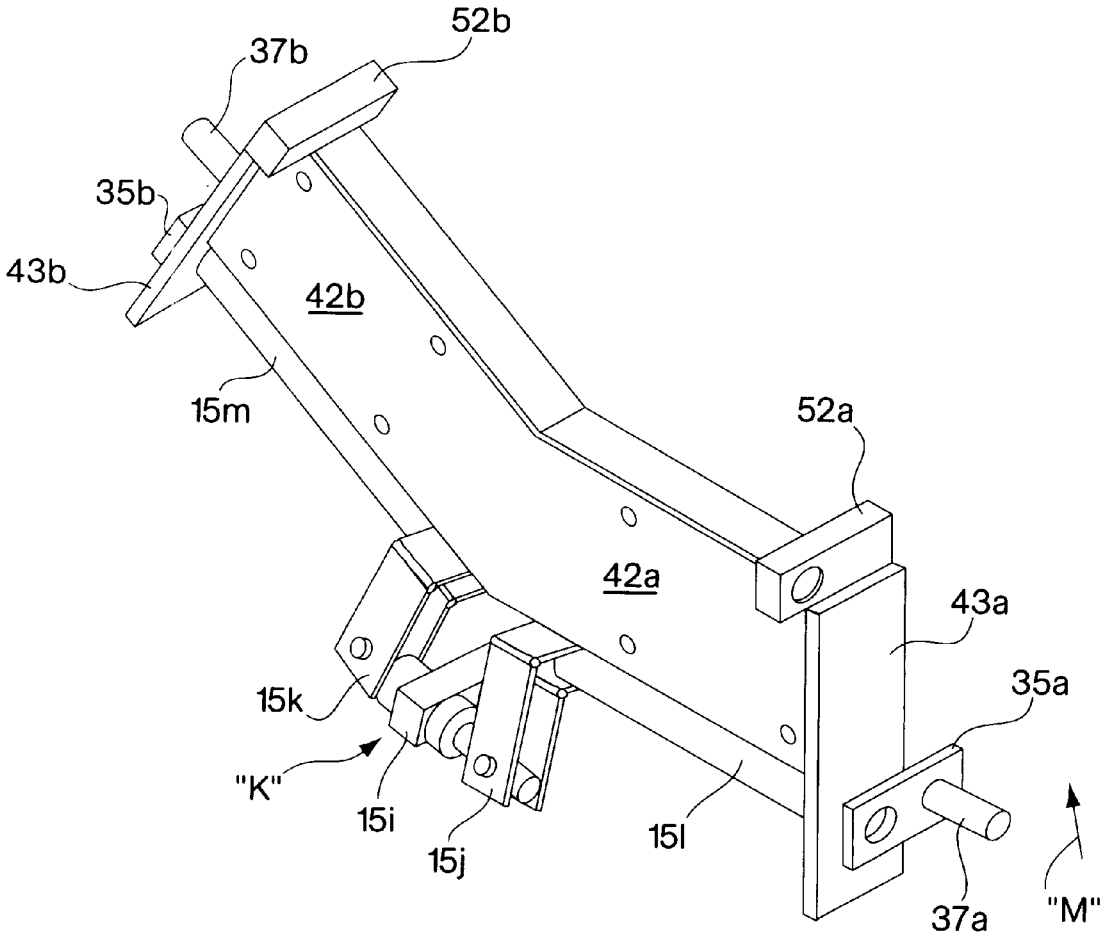
FIG. 9 is an exploded view of a portion of the four-bar linkage mechanisms of the incline press apparatus of FIG. 1.

Preferably located adjacent the seat 20 is a foot start 15, which when activated by a user allows the user to easily grasp the handles 16*a* and 16*b* in order to begin exercising, as is known in the art. Referring to FIGS. 8 and 9, the foot start 15 preferably includes an engagement rod 15*a* mounted to a first, forward end of an assist lever 15*b* such that engagement of the rod 15*a* by a user in the direction of arrow "G" moves the first end of assist lever also in the direction of arrow "G". The assist lever 15*b* is connected at a second end, opposite the first end, to one end of a rocker bar 15*c* by pin 15*d*, such that upon engagement of the engagement rod 15*a* by the user, the rocker bar 15*c* moves in the direction indicated by arrow "H". The assist lever 15*b* is further connected to the support member 18 by a rod 15*e*. The rocker bar 15*c* is, in turn, connected at an opposite end to a lift lever 15*f* by a pin 15*g*, such that movement of the rocker bar 15*c* in the direction of arrow "H" pivots the lift lever 15*f* in the direction indicated by arrow "I". The lift lever 15*f* is connected to the support member 18 by a rod 15*h*, and is connected at a second end to a plate 15*z*, such that pivoting the lift lever 15*f* in the direction of arrow "I", pivots the plate 15*z* in the direction indicated by arrow "J". The plate 15*z* is connected at a rearward end to a bar 15*i*, such that movement of the plate 15*z* in the direction of arrow J moves the bar 15*i* in the direction of arrow "K". The movement of the bar 15*i* in the direction of arrow "J" moves rockers 15*j* and 15*k*, and hence axes 15*l* and 15*m* which are connected thereto, in the direction of arrow "M" (FIG. 9). Axes 15*l* and 15*m* are in turn rotationally connected to corresponding stop arms 35*a* and 35*b* mounted thereto, with the rollers 37*a* and 37*b* of stop arms 35*a* and 35*b* abutting corresponding the primary lever arms 36*a* and 36*b*. Therefore, the movement of axes 15*k* and 15*l* moves stop arms 35*a* and 35*b* and rollers 37*a* and 37*b* in the direction of arrow "N" to move the primary lever arms 14*a* and 14*b* toward the user until the user is able to grip the handles 16*a* and 16*b*.

With continued reference to FIG. 1, the selectable weight mechanism 12 is preferably a high-mass, short-travel (HMST) weight stack. A HSMT weight stack provides the user with a higher mass weight stack and a shorter range of travel than conventional weight stacks. By increasing the mass and decreasing the range of travel, the speed of the selected weight decreases during use without slowing down the speed of the user as he or she exercises, as described hereinbelow. As the speed of the weight decreases, so also does the negative inertial effect, allowing a user to train at higher contractal velocities without the associated negative inertial effect associated with conventional selectable weights, as described above. Overcoming the negative inertial effect, in turn, results in a smoother and more predictable resistance through the complete range of motion.

Figure 5:
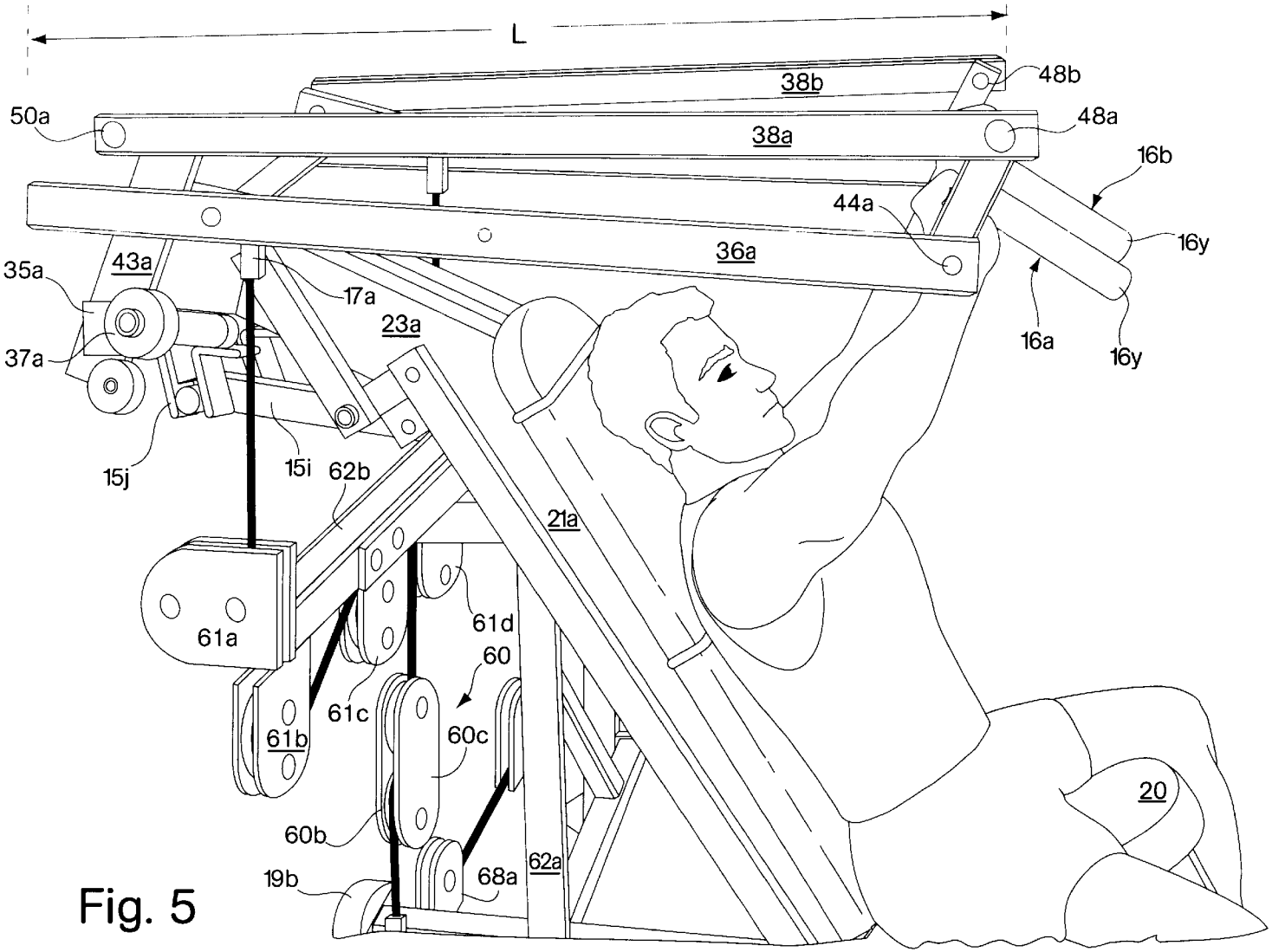
FIG. 5 is an enlarged side view of the incline press apparatus of FIG. 1 showing a user in an active position.

The selectable weight mechanism 12 is preferably disposed in an off center position relative to the exercise ready, seating position of the user, such that the user can readily access and manually select or adjust the degree of weight force from a seated, exercise ready position. In the present embodiment, weight mechanism 12 stands approximately 35 inches in height and preferably includes a housing 22 and a plurality of selectable weight plates 24 supported therein. Housing 22 is preferably supported by a stabilizer bar 22*a* and brace 22*b* (FIG. 6) which are both attached to support member 18. The total number of selectable weight plates 24 supported within housing 22 are referred to collectively as a "weight stack". In the present embodiment weight plates 24 are each approximately 0.75 inches thick and are uniform in weight, each plate weighing approximately 20 lbs in the present embodiment. A top weight plate 28 (FIG. 7) is operatively connected to a cable 30 and a central rod 32 (FIG. 5). Central rod 32 extends in a downward direction from top weight plate 28 through each of the consecutive weight plates 24. A pin 34 is insertable through a transverse hole in each plate, and into the central rod to select the desired amount of weight for the exercise routine to be performed, as is known in the art. Weights 24 are movable in a first and second substantially vertical direction along guide rods 26*a* and 26*b*, respectively, as will be described in greater detail herein below.

In the present embodiment, the selectable weight plates 24 preferably have a total mass of 400 lbs, which is twice the conventional mass (200lbs) utilized with a incline press machine. Also in the present embodiment, the selected weight plates 24 travel at approximately half the speed of a selected weight plate of a conventional incline press machine, therefore, the selected weight also is subjected to approximately half the acceleration over approximately half the distance of a conventional selected weight plate utilized with an incline press machine. The distance "W" (FIG. 2) that the selected weight plates travel is approximately 22.5% of the distance "DC" (FIG. 2) traveled by a user's hand, in the present embodiment, as measured by the distance between the vertical positions of handles 16*a* and 16*b* at the start and stop of the exercise. The distance "DC" is a function of the length of the user's arm. The distance a user's hand travels from the beginning to the end of one repetition of the exercise defines a complete range of motion. Although the mass is doubled, the total load the user feels during the performance of an exercise routine is the same as with a conventional incline press machine. This effect is achieved by changing the mechanical advantage to increase the leverage the user has over the selected weight plates from 1.8:1 (force exerted by user:weight) in a conventional system, to a 0.9:1 ratio in the present embodiment. The ratio is changed by attaching cable, 58 at an appropriate attachment point along primary lever arms 36*a* and 36*b*, in the present embodiment, as determined by conventional engineering techniques.

Figure 4:
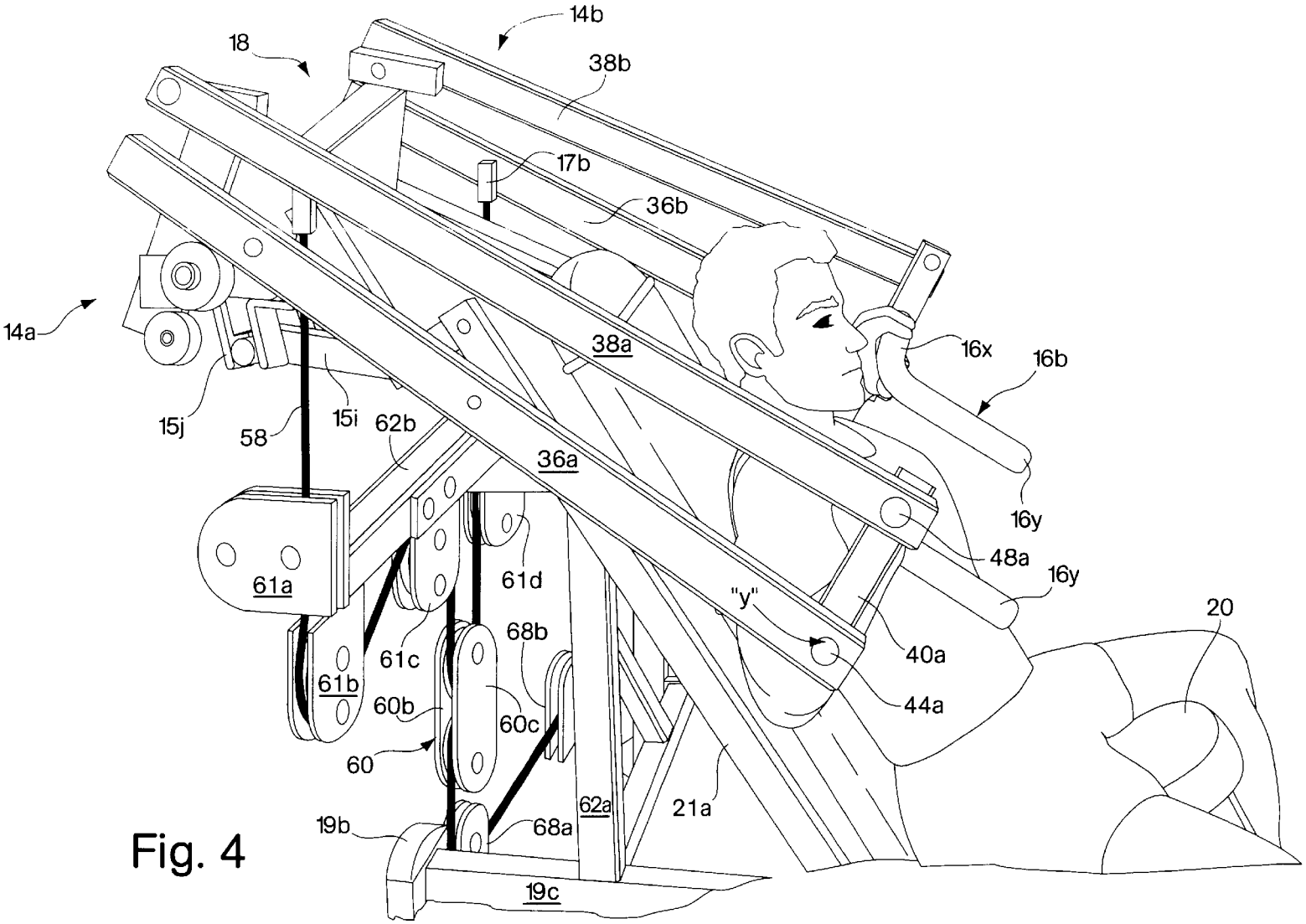
FIG. 4 is an enlarged side view of the incline press apparatus of FIG. 1 showing a user in a starting position.

Referring now to FIG. 3, the pulley blocks 17*a* and 17*b* (FIG. 4) preferably attach the cable 58 at a point which is located at approximately 22.5% of the distance between the pivot points 46*a* and 46*b* to pivot points 44*a* and 44*b*, starting from pivot points 46*a* and 46*b*, in the present embodiment. In the present embodiment, the total distance between the pivot points is approximately 30.5 inches in length, although the distance may range from approximately 25 to 35 inches. It should be understood that the placement of cable 58 depends upon the desired leverage, and the desired leverage depends upon the percentage increase in the mass of the weights, as compared to conventional weights. The criteria for determining the placement of cable 58 is that while performing an exercise on the incline press exercise apparatus of the present invention, the user should feel a resistance comparable to that felt while performing an exercise on a conventional incline press exercise apparatus while being able to exercise at higher contractal velocities. The increase in mass is, in turn, determined by several considerations, such as cost, structural load placed on the apparatus by the mass, as well as the ability to readily achieve the desired leverage for a given mass.

With continued reference to FIGS. 1 and 2, four-bar linkage mechanisms 14*a* and 14*b* having a length "L" (FIG. 5) are pivotally mounted at their rearward ends to the support member 18, and are operatively associated with selectable weight mechanism 12, as will be described in greater detail herein below. The four-bar linkages 14*a* and 14*b* are symmetrical in construction. Therefore, the below detailed description of four-bar linkage 14*a* is applicable to symmetrical four-bar linkage 14*b* as well. The four-bar linkage 14*a* preferably includes primary lever arm 36*a*, a follower lever arm 38*a*, a handle lever arm 40*a*, and a support arm 42*a*.

Preferably, the primary and follower lever arms lie and travel in a common plane which is tilted at an angle relative to a vertical plane, where the vertical plane is perpendicular to horizontal plane "A" underlying the base 19 of the apparatus. In the present embodiment, for ease of illustration, the tilted common plane is illustrated as plane "T" (FIG. 1) which is tilted with respect to a vertical plane "Z", where plane "Z" is perpendicular to plane "A" and intersects the y- axis, and where the y- axis bisects the seat 20. Although the common tilted plane "T" is illustrated with reference to the vertical plane "Z", any vertical may be used as a reference plane for the angular disposition of the four-bar linkages, provided such plane is perpendicular to the horizontal plane "A" underlying the apparatus, and on which it is supported, such as, for example, plane "B".

Figure 6:
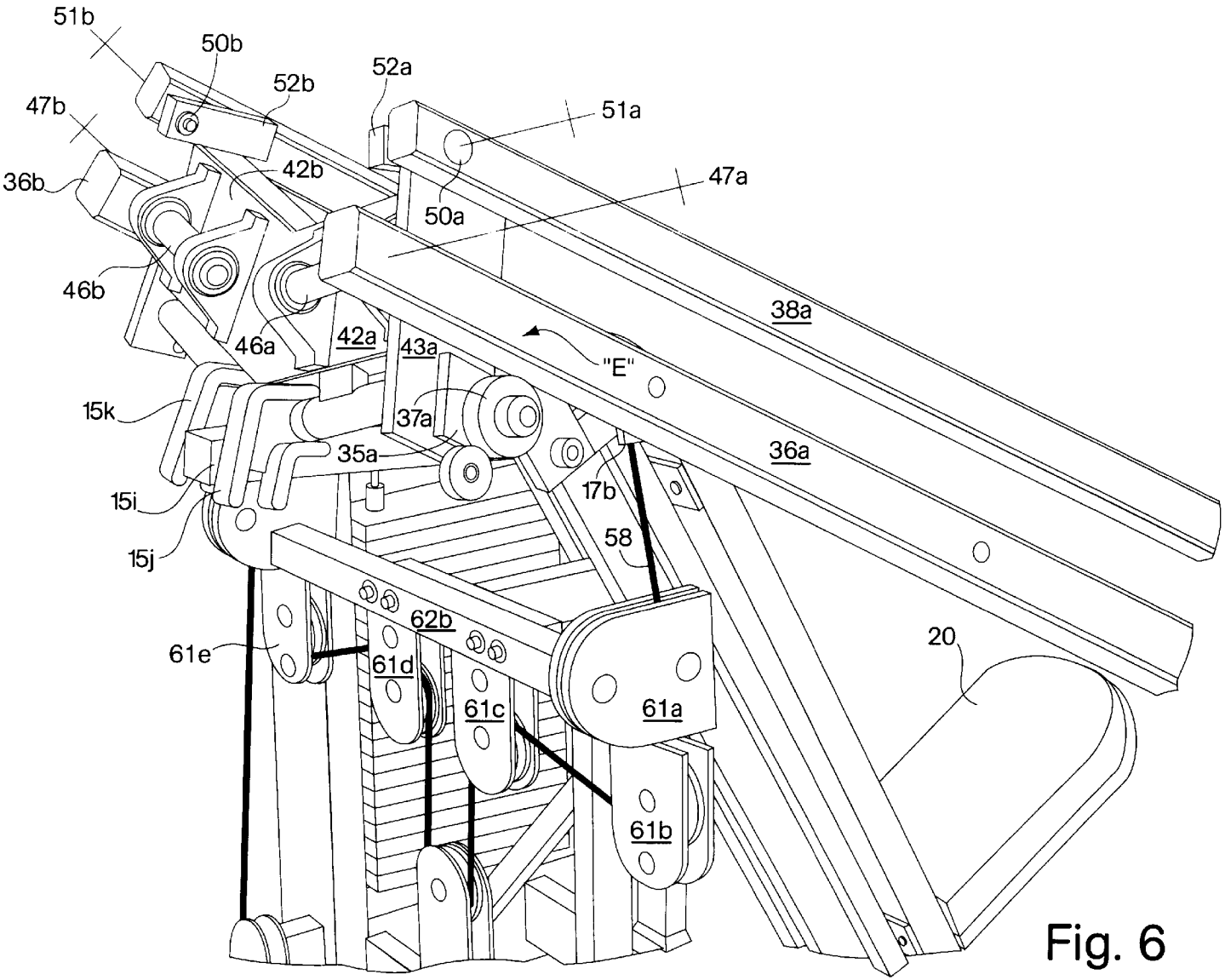
FIG. 6 is an enlarged view of the incline press apparatus of FIG. 1 showing the axes of the four-bar linkage mechanisms.

The primary lever arm 36*a* is preferably an elongated bar which is pivotally connected at a first, forward end to the handle lever arms 40*a*, by a pin 44*a* and is pivotally connected at second, rearward end, opposite the first end, by primary axle 46*a*, which is axially disposed about primary axis 47*a* (FIG. 6). The primary axle 46*a* is, in turn, mounted to the support arm 42*a*. In the present embodiment, the support arm 42*a* preferably includes a plate 43*a* having a stop arm 35*a* mounted thereto. The stop arm 35*a* includes a roller 37*a* which engages the primary lever arm 36*b* when the machine 10 is not in use, limits the downward movement of the four-bar linkages 14*a* and 14*b* in the direction of arrow "E", and assists in grasping the handles 16*a* and 16*b*, as previously described.

Follower lever arm 38*a* is likewise preferably an elongated bar which is pivotally connected at one end to handle lever arm 40*a* at a first pivot point 48*a*, by any suitable fastening device, such as a bolt, and is pivotally connected at its opposite, rearward end by secondary axle 50*a* (FIG. 6), which is axially disposed about secondary axis 51*a*. The distance between the pivot points 48*a* and 50*a* of the follower lever arm is preferably equal to the distance between the pivot points of the primary lever arm. In the present embodiment, the distance between pivot points 48*a* and 50*a* of the follower lever arm is approximately 30.5 inches, although alternate lengths are acceptable for both the primary and follower lever arms. In the present embodiment, the distance between primary axle 46*a* and secondary axle 50*a* is 3.75 inches. Also in the present embodiment, secondary axle 50*a* is mounted to block 52*a* FIG. 2) which is part of the support arm 42*a*. The block 52*a* is preferably welded to the support arm 42*a*, but may be attached in any suitable manner provided block 52*a* remains stationary while supporting the follower lever arm 38*a*. Alternatively, the secondary axle 50*a* may be directly mounted to support arm 42*a*.

In the present embodiment, the primary axes 47*a* and 47*b* are preferably disposed at an angle with respect to a horizontal plane "A" underlying the machine 10. Angle θ(FIG. 3) is the angle disposed between the angled primary axes 47*a* and 47*b*, which may range from about 135 to about 165 degrees. For an incline press machine according to the present embodiment, the angle θ is preferably 150 degrees. The primary concern with regard to the angle θ is that convergence take place in the upward, or pushing direction. In determining the preferred angle employed, several considerations are taken into account, including, but not limited to, the starting and ending points of a handles 16*a* and 16*b*, which allow the correct biomechanical positioning of the user's wrists and forearms to be maintained. These points help determine the maximum angle θ, or in other terms, the maximum upward convergence of the four bar linkages 14*a* and 14*b*. In the present embodiment, the secondary axles 50*a* and 50*b* are preferably spaced from and are parallel to the primary axles 46*a* and 46*b*. The primary axles 47*a* and 47*b* are also preferably disposed parallel with respect to a plane "B" (FIG. 2), plane "B" being perpendicular to horizontal plane "A" (FIG. 1).

Figure 2:
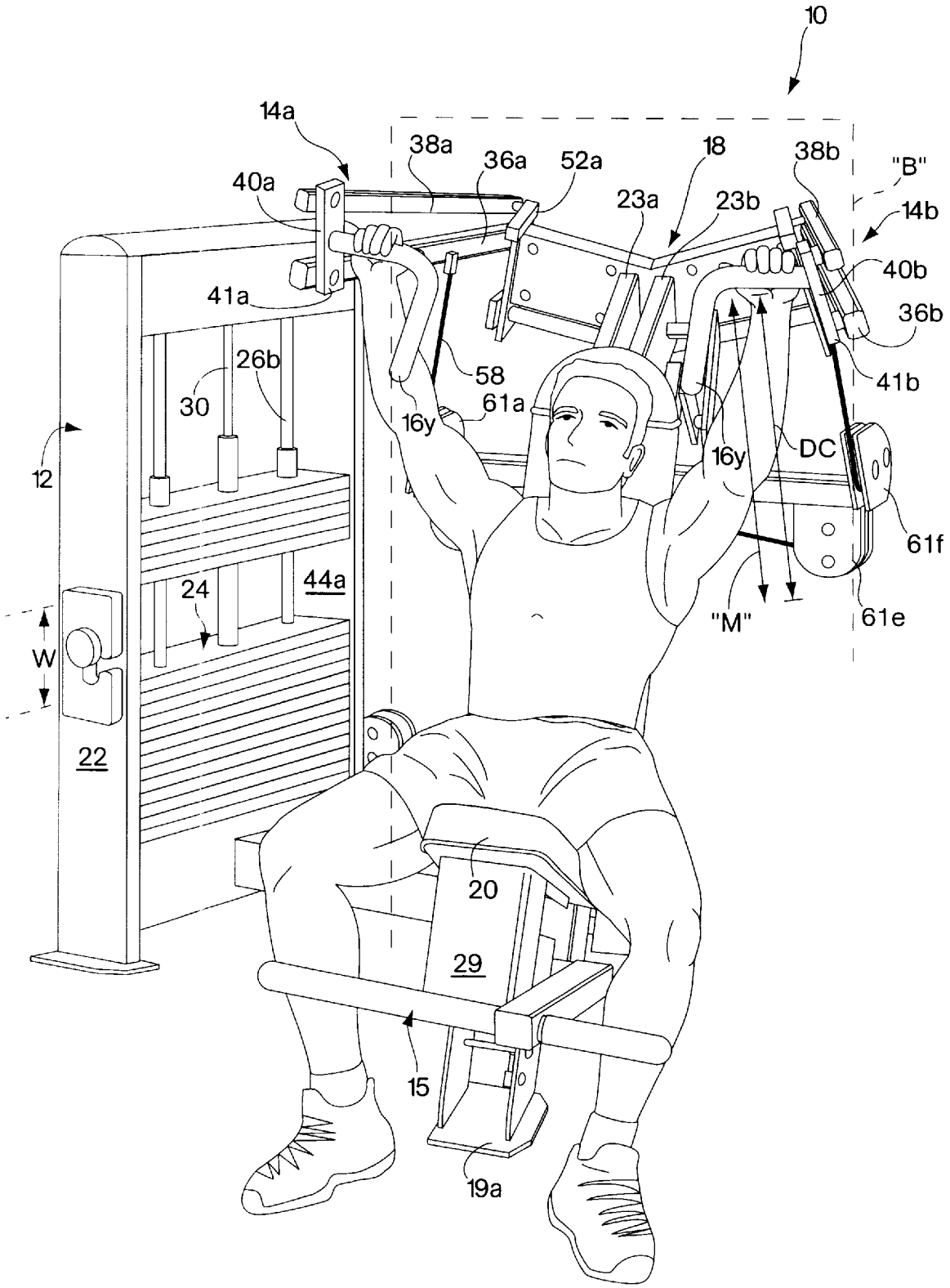
FIG. 2 is a perspective view of the incline press apparatus of FIG. 1 illustrating various planes of reference and with the user in an active position using a horizontal grip.

With continuing reference to FIGS. 1 and 2, the handle lever arm 40*a* is the forward most component of the four bar linkage 14*a*. The handle lever arm 40*a* is approximately 4.5 inches in length between the pivot points 44*a* and 48*a* includes a handle 16*a* extending therefrom. The handle lever arm is operatively associated with the primary and secondary lever arms such that when the prima arms are displace lever arms are displaced from one position to another position, i.e. pivoted, the handle lever arm is pivoted relative to the primary and secondary level arms around the pivot points 44*a* and 48*a*, but remains relatively constant in its orientation relative to the horizontal and vertical planes. In the present embodiment, the follower lever arm 38*a* is preferably not disposed parallel with respect to primary lever arm 36*a*.

Figure 7:
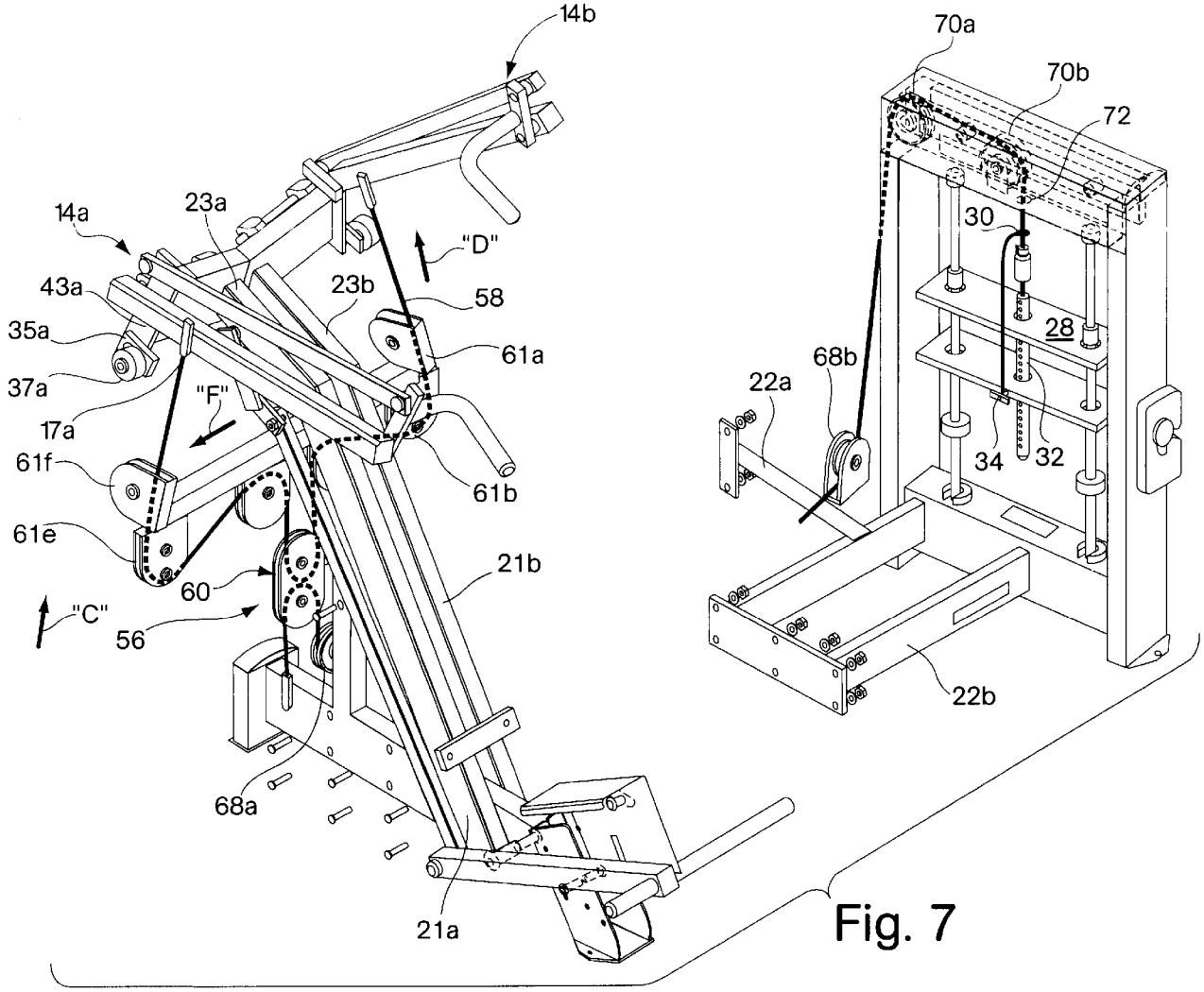
FIG. 7 is an exploded view of the incline press apparatus of FIG. 1.

The handle 16*a* is preferably rigidly connected to the handle lever arm 40*a*, and preferably includes a first handle portion 16*x* extending in a first, perpendicular direction therefrom, and a second handle portion 16*y* curving outwardly from the first portion 16*x*, preferably at a 90° angle, and preferably slightly downwardly. Such an arrangement enables a slight rotational movement of the bottom end 41*a* of the handle lever arm 40*a* in the direction of arrow "y" during operation, resulting in a slight tilt of the handle 16*a* through the complete range of motion. Such a slight tilt of the handle assists the user in maintaining the proper biomechanical alignment of the user's wrist and forearm during performance of the exercise, as previously described. The handle 16*a* is preferably rigidly connected to the handle lever arm 40*a*, extends in a first, perpendicular direction therefrom, curves outwardly, preferably at a 90° angle, and preferably slightly downwardly. With such an arrangement, a user may choose either a grip which is perpendicular or substantially parallel to the handle lever arm 40*a*. Such grips are also known as horizontal (FIG. 1) and neutral grips, respectively. When a horizontal grip is used, i.e. when the user grasps handle portions 16*x* so that their hands are substantially perpendicular to the handle lever arm 40*a*, as shown in FIGS. 7 and 8, then the tilted axes maintain the correct biomechanical alignment of the wrists. When a neutral grip is used, i.e., when the user grasps handle portions 16*y* so that their hands are substantially parallel to handle lever arm 40*a*, as shown in FIGS. 9 and 10, the four-bar linkage mechanisms also enable the user to maintain the correct biomechanical alignment of the joints. In either case, the handle does not substantially twist or change orientation relative to the horizontal (A) and vertical (Z and B) planes throughout the user's complete range of motion, i.e., displacement of the four-bar linkage mechansims. Alternatively, the handle 16*a* may extend at any orientation with respect to the handle lever arm 40*a*, provided the orientation allows the user to comfortably grip the handle while preferably properly aligning the user's hands with respect to the user's wrists. In the present embodiment the handle 16*a* is welded to the handle lever arm 40*a*, although other attachment methods may be utilized provided that the handle 16*a* remains substantially stationary with respect to the handle lever arm 40*a*. The handle 16*a* is also preferably covered with foam for user comfort.

Referring now to FIG. 7, a pulley system 56 preferably includes a cable 58 attached at a first end to the primary lever arm 36*a* and attached at a second end to the primary lever arm 36*b*. In the present embodiment, the cable 58 is preferably attached by pivot blocks 17*a* and 17*b* to both primary lever arms 36*a* and 36*b*, respectively. The cable 58 is attached at approximately 22.5% of the distance between first pivot points 44*a* and 44*b* to second pivot points 46*a* and 46*b*, respectively, as measured starting from second pivot points 46*a* and 46*b*, in order to increase the mechanical advantage the user has over the weight to be lifted.

In order to effectuate movement of the selected weight by actuation of either, or both of the four-bar linkages 14*a* and 14*b*, the cable 58 is routed from the primary lever arm 36*a*, through a plurality of secondary pulleys 61*a*, 61*b* and 61*c*, respectively, and through a floating pulley 60. From the floating pulley 60, the cable 58 is routed through a plurality of secondary pulleys 61*d*, 61*e* and 61*f* for attachment to the primary lever arm 36*b*. The secondary pulleys 61*a* through 61*f* operate to route the cable from attachment to the four-bar linkages 14*a* and 14*b* to the floating pulley 60 in an unobtrusive manner which is easy to access for replacement or repairs, while not interfering with the exercise motions of the user. It will be understood to those skilled in the art that because secondary pulleys 61*a* through 61*f* are utilized to route the cable 58 to the floating pulley 60, any number of pulleys may be utilized in a variety of orientations, as long as routing to the floating pulley is achieved.

The floating pulley 60 preferably consists of a pulley 60*a* disposed between two side plates 60*b* and 60*c*, is connected to a fixed pulley 63 at one end thereof, and is movable by the cable 58 in the direction indicated by arrow "C". In operation, a user will begin from a starting position, as shown in FIG. 1, and push on the handles 16*a* and 16*b*, either simultaneously, or one at a time, in an outward and upward direction, indicated by arrow "E" (FIG. 3). If the handles are pushed on simultaneously, as shown in FIG. 1, both of the primary lever arms 36*a* and 36*b* operate to put the cable 58 in a state of tension, which in turn puts tension on the floating pulley 60. The tension on the floating pulley 60 is sufficient to move it in the direction of arrow "C", from an initial, at rest position, to a second, active position. Alternatively, if the user chooses to push on only one handle at a time, for example, handle 16*b*, then the cable is initially moved in the direction of arrow "D" (FIG. 7), as described below.

Movement of the handle 16*b*, and hence, the cable 58 in the direction indicated by arrow "D" places tension on the cable, which is initially transferred to the primary lever arm 36*a*. During movement of handle 16*b*, handle 16*a* is preferably still grasped by the user. Therefore, the force initially transferred to the primary lever arm 36*a* will not operate to move the lever arm, as the movement will be resisted by the user's grip on the handle 16*a*. Alternatively, if the user does not resist the force from the cable 58, the primary lever arm will move in the direction of arrow "F", until such time as roller 37*a* of the stop arm 35*a* abuts the primary lever arm 36*a*, as previously described. In either case, the force exerted on and through the cable 58 will ultimately be transferred through the floating pulley 60 and will operate to move the floating pulley 60 in the direction of arrow C, as discussed above. The above description is also applicable to movement of the handle 16*a*, with the force being initially transferred to the primary lever arm 36*b*. It will be understood to those skilled in the art that since the pulleys are utilized to route the cable 58 to the floating pulley 60, any number of pulleys may be utilized in a variety of orientations, as long as routing to the floating pulley is achieved.

The floating pulley 60 is attached at one end to the cable 30 by a pulley 63 (see FIG. 7), which is mounted to the support member 18. Therefore, movement of floating pulley 60 in the direction of arrow C also operates to move the cable 30 in the direction of arrow C. As shown in FIG. 3, the cable 30 is routed through a pulley 68*a*, attached to support member 18 and through pulley 68*b*, and attached to the exterior of weight mechanism 12. The cable 30 is then received within the housing 22 of the selectable weight mechanism 12, where it is preferably routed through pulleys 70*a* and 70*b* (FIG. 7). Pulleys 70*a* and 70*b* operate to orientate the cable above the plurality of selectable weights 24 disposed within the housing 22. The cable 30 exits the housing at an aperture 72 where it is operatively connected to the central rod 32, as previously described. Again, any number of pulleys may be utilized to route the cable 30, as long as the cable is operatively connected to the central rod 32.

The operation of the incline press machine 10 will now be described with reference to FIGS. 1–9. Prior to performance of an exercise routine, a user will first adjust the seat 20 to a desired position in which the user's feet will preferably be in contact with the floor 17. The user then selects the desired weight for performance of the exercise by inserting pin 34 into the transverse hole of the appropriate weight plate, as previously described. Due to the off-center orientation of the selectable weight mechanism 12 with respect to the seat 20, the user may select the weight from either a seated or a standing position. In either case, after the weight has been selected, the user should be seated in the seat 20 with the user's back preferably resting against the support cushion 27. The direction the user is facing is considered the forward facing direction for purposes of this invention. After the user is properly seated, the user pushes on the foot start 15 with his or her foot in order to move the four-bar linkages 14*a* and 14*b*, and hence handles 16*a* and 16*b* toward the user so that the user can readily grasp either one, or both of the handles 16*a* and 16*b*, as previously described. Once the user has grasped the handles 16*a* and 16*b*, in either a horizontal or neutral grip, the user is ready to perform an incline press exercise. As stated above, when a horizontal grip is used, the tilted axes maintain the proper alignment of the wrists, and when a neutral grip is used, the four-bar linkage mechanisms enable the user to maintain the proper biomechanical alignment of the joints.

The user performs the incline press exercise by first pushing on the handles 16*a* and 16*b* in an upward and outward direction as indicated by arrow "E" (FIG. 3). As the user begins pushing in the direction as indicated by arrow "E", the bottom end 41 of the handle lever arm 40*a* begins to rotate slightly in the direction of arrow "Y" FIG. 4), resulting in a slight tilt of handles 16*a* and 16*b* through the range of motion of the exercise, but not as much tilt as the angular deflection of primary arms 36*a* and 36*b*. This slight tilt is enabled by the four-bar linkage mechanisms 14*a* and 14*b* in order to maintain proper biomechanical alignment of the user's wrist and forearm during performance of the exercise.

As the user continues to move handles 16*a* and 16*b* in the outward direction, due to the orientation of the primary axles 46*a* and 46*b*, and the secondary axles 50*a* and 50*b*, the four-bar linkage mechanisms 14*a* and 14*b* travel in planes which are tilted relative to vertical. Therefore, the planes in which the four-bar linkages travel are not perpendicular with respect to the plane "A" underlying the machine 10, as previously described. The tilted planes through which the four bar linkage mechanisms travel enable the handles 16*a* and 16*b* to travel in a slightly curvilinear upwardly converging and downwardly diverging path, which is illustrated as "M" in FIG. 2. Such a movement simulates as natural a human musculoskeletal outward pushing motion as possible while maintaining proper biomechanical alignment of the user's joints. As the user is pushing handles 16*a* and 16*b* in the outward direction, the cable 58 is placed in a state of tension and the floating pulley 60 is moved into the active position, as described above. Activation of the floating pulley 60 operates to move the selected weights vertically, in an upward direction within the housing 22. Once the user has fully extended his or her arms as shown in FIG. 2, the user then allows the handles 16*a* and 16*b* to return to the starting position for the exercise.

The handles 16*a* and 16*b* move along the same path of travel, but in the downward direction, until the handles are returned to the starting position. As the user allows the handles to move toward the starting position, the four-bar linkages travel through the tilted planes once again, this time in the inward direction with respect to the user. While the user is allowing the handles 16*a* and 16*b* to return to the starting position, the selected weights are moving in a vertical, downward direction, within the housing 22. Once the user reaches the starting point of the exercise, one repetition has been completed through the range of motion of the user.

It will be understood that various modifications may be made to the embodiment disclosed herein. For example, all lengths and angles given are approximate and may be varied by one of skill in the art, the machine may be utilized with, or without a high-mass, short-travel weight stack, the machine may be utilized with or without a seat, the primary lever arms may be parallel without substantially effecting the biomechanical alignment of the user's joints. Therefore, the above description should not be construed as limiting, but merely as exemplifications of a preferred embodiment. Those skilled in the art will envision other modifications within the scope spirit of the invention.

What is claimed is:

1. An incline press exercise apparatus, comprising:

a base member for supporting the apparatus on a horizontal plane and defining a first vertical plane normal thereto and a second vertical plane orthogonal to the first;

a support member extending from the base member;

a pair of four-bar linkage mechanisms supported by the support member, the pair of four-bar linkage mechanisms each including a primary lever arm pivotable about a primary axis and a follower lever arm pivotable about a secondary axis, the primary axes being disposed at an angle with respect to each other and to the second vertical plane, such that the lower end of the primary axes are tilted inwardly toward each other and the second vertical plane, the primary and follower lever arms lying in a common plane tilted at an angle relative to the first vertical plane;

a handle operatively associated with each of the four-bar linkage mechanisms;

a weight mechanism operatively associated with the pair of four-bar linkage mechanisms for resisting movement of the four bar linkage mechanisms; and wherein the primary and follower lever arms travel in the common plane as the pair of four-bar linkage mechanisms are displaced between a first position and a second position while maintaining a correct biomechanical positioning.

2. The incline press exercise apparatus of claim 1, further comprising:

a handle lever arm operatively associated with both of the primary and follower arms of each of the pair of four-bar linkage mechanisms, wherein each handle extends outwardly and perpendicularly from one of the handle lever arms, and curves outwardly and downwardly therefrom at a 90 degree angle, such that the handles travel in a slightly curvilinear upwardly converging and downwardly diverging path as the four-bar linkage mechanisms are displaced between a first position and a second position while maintaining a correct biomechanical positioning.

3. The incline press exercise apparatus of claim 1, wherein the support member further comprises an extension arm and a support arm connected to the extension arm, and the primary and secondary axes are aligned with the support arm such that the pair of four-bar linkage mechanisms are pivotally supported by the support member.

4. The incline press exercise apparatus of claim 3, wherein each four-bar linkage mechanism further comprises a handle lever arm pivotally connected to both the primary lever arm and the follower lever arm.

5. The incline press exercise apparatus of claim 4, wherein each handle extends from one of the handle lever arms and is adapted to be gripped by the hand of a user.

6. The incline press exercise apparatus of claim 5, wherein each handle lever arm is pivotally connected to the primary lever arm about a first pivot point and to the follower arm about a second pivot point.

7. The incline press exercise apparatus of claim 6, wherein the distance between the first pivot point and the second pivot point on each handle lever arm is about 4.5 inches.

8. The incline press exercise apparatus of claim 5, wherein each handle includes a first handle portion extending in a first perpendicular direction from the handle lever arm, and a second handle portion extending in a second direction from the first handle portion, such that the handles travel in a slightly curvilinear upwardly converging and downwardly diverging path as the four-bar linkage mechanisms are displaced between a first position and a second position while maintaining a correct biomechanical positioning.

9. The incline press exercise apparatus of claim 8, wherein the second handle portion extends outwardly and perpendicularly from the first handle portion.

10. The incline press exercise apparatus of claim 9, wherein the second handle portion curves outwardly and downwardly from the first handle portion.

11. The incline press exercise apparatus of claim 1, further comprising a cable portion operatively associated with the weight mechanism for pulling the weight mechanism, attached at an attachment point between the first pivot point and the second pivot point of each primary lever arm.

12. The incline press exercise apparatus of claim 11, wherein the attachment point is about 22.5% of the distance between the first pivot point and the second pivot point of the primary lever arms, as measured starting from the second pivot point.

13. The incline press exercise apparatus of claim 12, wherein the distance between the first pivot point and the second pivot point on each primary lever arm is between about 25 to about 35 inches.

14. The incline press exercise apparatus of claim 13, wherein the distance between the first pivot point and the second pivot point on each primary lever arms is about 30.5 inches.

15. The incline press exercise apparatus of claim 11, wherein the primary lever arms are spaced apart from the follower lever arms.

16. The incline press exercise apparatus of claim 1, wherein the primary axes are parallel to and spaced apart from the secondary axes.

17. The incline press exercise apparatus of claim 16, wherein the primary axes are parallel to the first vertical plane.

18. The incline press exercise apparatus of claim 17, wherein the primary axes are spaced apart from the secondary axes by a distance of about 3.75 inches.

19. The incline press exercise apparatus of claim 18, wherein the primary axes of each four-bar linkage are disposed at an angle of between about 135 to about 165 degrees with respect to each other.

20. The incline press exercise apparatus of claim 19, wherein the primary axes of each four-bar linkage are disposed at an angle of about 150 degrees with respect to each other.

21. The incline press exercise apparatus of claim 1, wherein the support member is disposed at an angle with respect to the first vertical plane.

22. The incline press exercise apparatus of claim 21, wherein the support member is disposed at an angle of about 30 degrees with respect to the first vertical plane.

23. An incline press exercise apparatus comprising:

a base member for supporting the apparatus on a horizontal plane and defining a first vertical plane normal thereto and a second vertical plane orthogonal to the first;

a support member extending from the base member;

a first and a second four-bar linkage mechanism, the first and second four-bar linkage mechanisms each including a primary lever arm pivotable about a primary axis and a follower lever arm pivotable about a second axis, the primary axes being disposed at an angle with respect to each other and to the second vertical plane, such that the lower end of the primary axes are tilted inwardly toward each other and the second vertical plane;

the primary and follower lever arms being pivotable in a common plane tilted at an angle relative to the second vertical plane;

a weight mechanism operatively associated with the pair of four-bar linkage mechanisms for resisting movement of the four-bar linkage mechanisms; and the support member comprising at least one post member connected to the base member and extending upwardly behind a seat, the first and second four-bar linkage mechanisms being supported on the at least one post member above and behind the seat;

wherein the primary and follower lever arms travel in the common plane as the four-bar linkage mechanisms are displaced between a first position and a second position.

24. An incline press exercise apparatus comprising:

a base member for supporting the apparatus on a horizontal plane and defining a first vertical plane normal thereto and a second vertical plane orthogonal to the first;

a support member extending from the base member;

a first and a second four-bar linkage mechanism supported by the support member, the first and second four-bar linkage mechanisms each including a primary lever arm pivotable about a primary axis and a follower lever arm pivotable about a second axis, the primary axes being disposed at an angle with respect to each other and to the second vertical plane, such that the lower end of the primary axes are tilted inwardly toward each other and the second vertical plane;

the primary and follower lever arms being pivotable in a common plane tilted at an angle relative to the second vertical plane;

wherein the primary and follower lever arms travel in the common tilted plane as the four-bar linkage mechanism are displaced between a first position and a second position;

the first and second four-bar linkage mechanisms each having a length, and each being pivotally supported at a first selected position along the length and each having a handle connected to a second selected position along the length;

the apparatus including a seat which is adapted to position a user in a disposition relative to the handles such that the handles are manually engageable by the user for pressing the handles between the first position and the second position in an incline press motion.

25. An incline press exercise apparatus comprising:

a base member for supporting the apparatus on a horizontal plane and defining a first vertical plane normal thereto and a second vertical plane orthogonal to the first;

a support member extending from the base member;

a first and a second four-bar linkage mechanism supported by the support member, the first and second four-bar linkage mechanisms each including a primary lever arm pivotable about a primary axis and a follower lever arm pivotable about a second axis, the primary axes being disposed at an angle with respect to each other and to the second vertical plane, such that the lower end of the primary axes are tilted inwardly toward each other and the second vertical plane;

the primary and follower lever arms being pivotable in a common plane tilted at an angle relative to the second vertical plane;

a weight mechanism operatively associated with the pair of four-bar linkage mechanisms for resisting movement of the four-bar linkage mechanisms;

wherein the primary and follower lever arms travel in the common tilted plane as the four-bar linkage mechanisms are displaced between a first position and a second position;

a handle lever arm operatively associated with each of the primary and follower lever arms;

the handle lever arm having a manually engageable handle for moving the four-bar linkage mechanisms between the first and second positions, the handle being disposed in a predetermined gripping orientation in the first position, the operative association of the handle lever arm with the primary and follower arms maintaining the handle extension in the predetermined gripping orientation during displacement of the four-bar linkage arms between the first and second positions.

26. An incline press exercise machine comprising:

a base member for supporting the apparatus on a horizontal plane and defining a first vertical plane normal thereto and a second vertical plane orthogonal to the first;

a support member extending from the base member;

a first and a second four-bar linkage mechanism supported by the support member, the first and second four-bar linkage mechanisms each including a primary lever arm pivotable about a primary axis and a follower lever arm pivotable about a second axis, the primary axes being disposed at an angle with respect to each other and to the second vertical plane, such that the lower end of the primary axes are tilted inwardly toward each other and the second vertical plane the primary and follower lever arms being pivotable in a common plane tilted at an angle relative to a vertical plane;

a handle operatively associated with each of the primary and follower arms of each of the pair of four-bar linkage mechanisms;

wherein the primary and follower lever arms travel in the common tilted plane as the four-bar linkage mechanisms are displaced between a first position and a second position;

wherein at least one of the primary and follower lever arms of each of the four-bar linkage mechanisms is operatively associated with a cable and a selected portion of a selectable weight stack, the selected portion of the weight stack being displaced by a distance upon movement of each four-bar linkage mechanisms from a first position to a second position.

27. The apparatus of claim 26, wherein the primary and follower lever arms each have a length, a handle being interconnected to a first position and the cable being interconnected to a second position along the length of at least one of the four-bar linkage mechanisms, the first and the second positions being selected such that the selected portion of the weight stack travels through a distance less than about 60% of the displacement distance of the handle upon displacement of the handle from a first position to a second position.

* * * * *